US009383697B1

(12) United States Patent
Miyahara et al.

(10) Patent No.: US 9,383,697 B1
(45) Date of Patent: Jul. 5, 2016

(54) LENS, FIXING DEVICE, AND IMAGE FORMING APPARATUS

(71) Applicant: FUJI XEROX CO., LTD., Tokyo (JP)

(72) Inventors: Tomoko Miyahara, Kanagawa (JP); Takashi Matsubara, Kanagawa (JP); Tetsuro Kodera, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/834,937

(22) Filed: Aug. 25, 2015

(30) Foreign Application Priority Data

Jan. 6, 2015 (JP) ..... 2015-000839

(51) Int. Cl.
*G03G 15/20* (2006.01)

(52) U.S. Cl.
CPC ..... *G03G 15/2053* (2013.01)

(58) Field of Classification Search
CPC ..... G03G 15/201; G03G 15/2007
See application file for complete search history.

(56) References Cited

U.S. PATENT DOCUMENTS 8,948,674 B2 * 2/2015 Kodera ..... G03G 15/201 399/329
9,037,025 B2 * 5/2015 Kodera ..... G03G 15/2007 399/320
2005/0041307 A1 * 2/2005 Barone ..... G02B 3/08 359/742

FOREIGN PATENT DOCUMENTS

JP 2011-128223 A 6/2011

* cited by examiner

*Primary Examiner* — Gregory H Curran
(74) *Attorney, Agent, or Firm* — Oliff PLC

(57) ABSTRACT

Provided is a lens including a curved surface including a top portion at one end of the lens, wherein a groove is formed on the curved surface, and wherein light incident to the curved surface is concentrated on the other end of the lens.

10 Claims, 19 Drawing Sheets

LENS, FIXING DEVICE, AND IMAGE FORMING APPARATUS

CROSS-REFERENCE TO RELATED APPLICATIONS

This application is based on and claims priority under 35 USC 119 from Japanese Patent Application No. 2015-000839 filed Jan. 6, 2015.

BACKGROUND

Technical Field

The present invention relates to a lens, a fixing device, and an image forming apparatus.

SUMMARY

According to an aspect of the invention, there is provided a lens including:

a curved surface including a top portion at one end of the lens, wherein a groove is formed on the curved surface, and wherein light incident to the curved surface is concentrated on the other end of the lens.

BRIEF DESCRIPTION OF THE DRAWINGS

Exemplary embodiments of the present invention will be described in detail based on the following figures, wherein.

DETAILED DESCRIPTION

Outline

Figure 1:
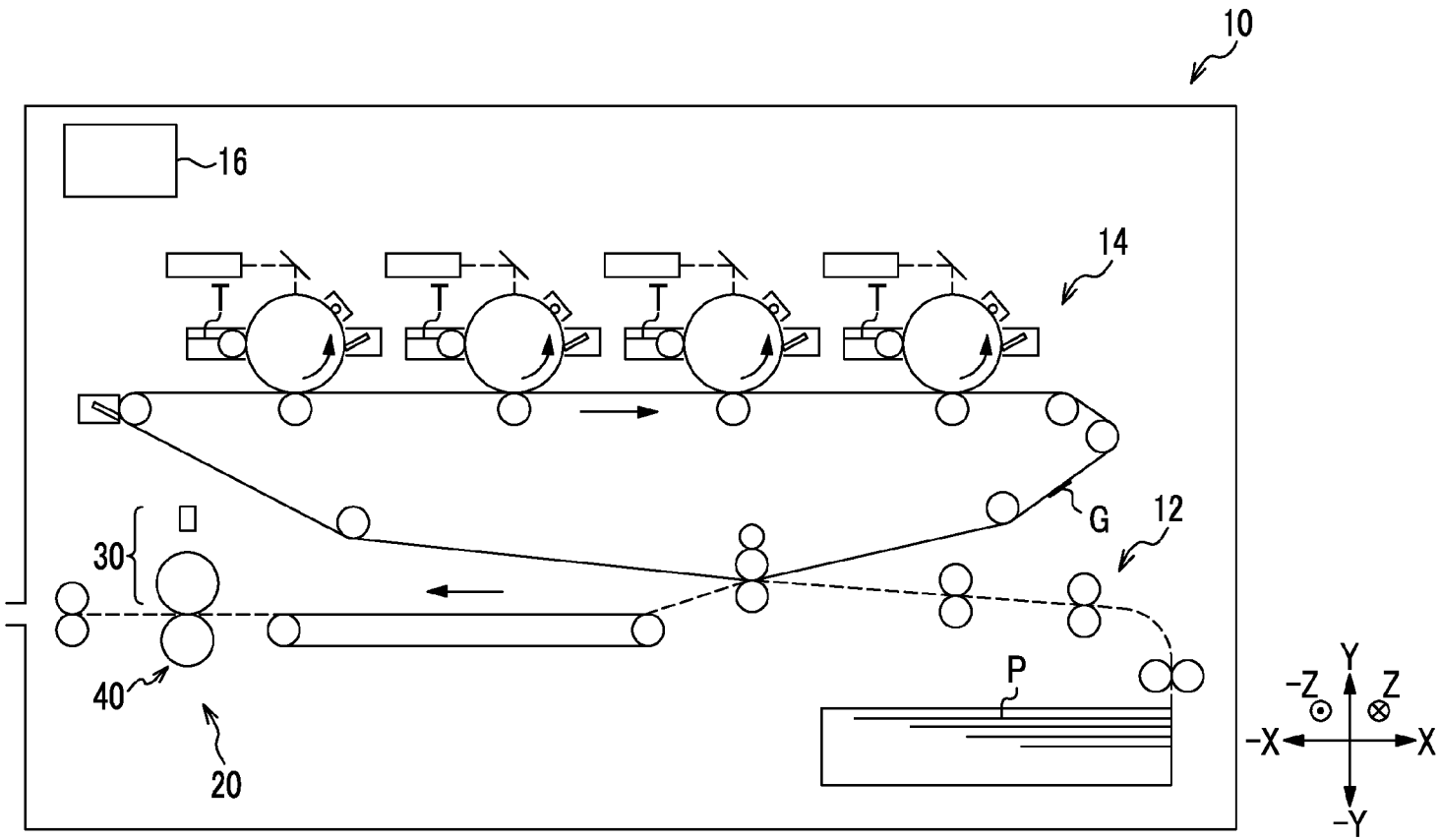
FIG. 1 is a schematic diagram (front view) showing an image forming apparatus according to a first exemplary embodiment.

Hereinafter, five exemplary embodiments (first to fifth exemplary embodiments) that are exemplary embodiments according to the invention (hereinafter, referred to as exemplary embodiments) will be described with reference to the drawings.

In the following description, it is assumed that a direction represented by an arrow X and an arrow −X in the drawings is an apparatus width direction, and a direction represented by an arrow Y and an arrow −Y in the drawings is an apparatus height direction. It is assumed that a direction (a direction represented by an arrow Z and an arrow −Z) perpendicular to the apparatus width direction and the apparatus height direction is an apparatus depth direction. When it is necessary to distinguish one side of the apparatus width direction, the apparatus height direction or the apparatus depth direction from the other side thereof, it is assumed that a side of the arrow X is one side, a side of the arrow −X is the other side, a side of the arrow Y is an upper side, a side of the arrow −Y is a lower side, a side of the arrow Z is a back side, and a side of the arrow −Z is a front side.

First Exemplary Embodiment

Outline

Hereinafter, the present exemplary embodiment will be described. The entire configuration of an image forming apparatus 10 according to the present exemplary embodiment will be first described. Subsequently, the configuration of a fixing device 20 according to the present exemplary embodiment will be described. Subsequently, the operation of the image forming apparatus 10 according to the present exemplary embodiment will be described. Subsequently, the effects according to the present exemplary embodiment will be described.

Entire Configuration of Image Forming Apparatus

As shown in FIG. 1, the image forming apparatus 10 is an electrographic image forming apparatus that is configured to include a transport unit 12, a toner image forming unit 14, a control unit 16, and the fixing device 20. The transport unit 12 has a function of transporting a medium P. The toner image forming unit 14 has a function of forming a toner image G with toner T on the transported medium P by performing the processes such as charging, exposing, developing, and transferring. The control unit 16 has a function of controlling respective units except for the control unit 16 which constitutes the image forming apparatus 10. The fixing device 20 has a function of fixing the toner image G onto the medium P. Here, the toner T is an example of a developer and an object to be fixed. The toner image G is an example of a developer image. The toner image forming unit 14 is an example of a forming unit.

Fixing Device

Figure 2:
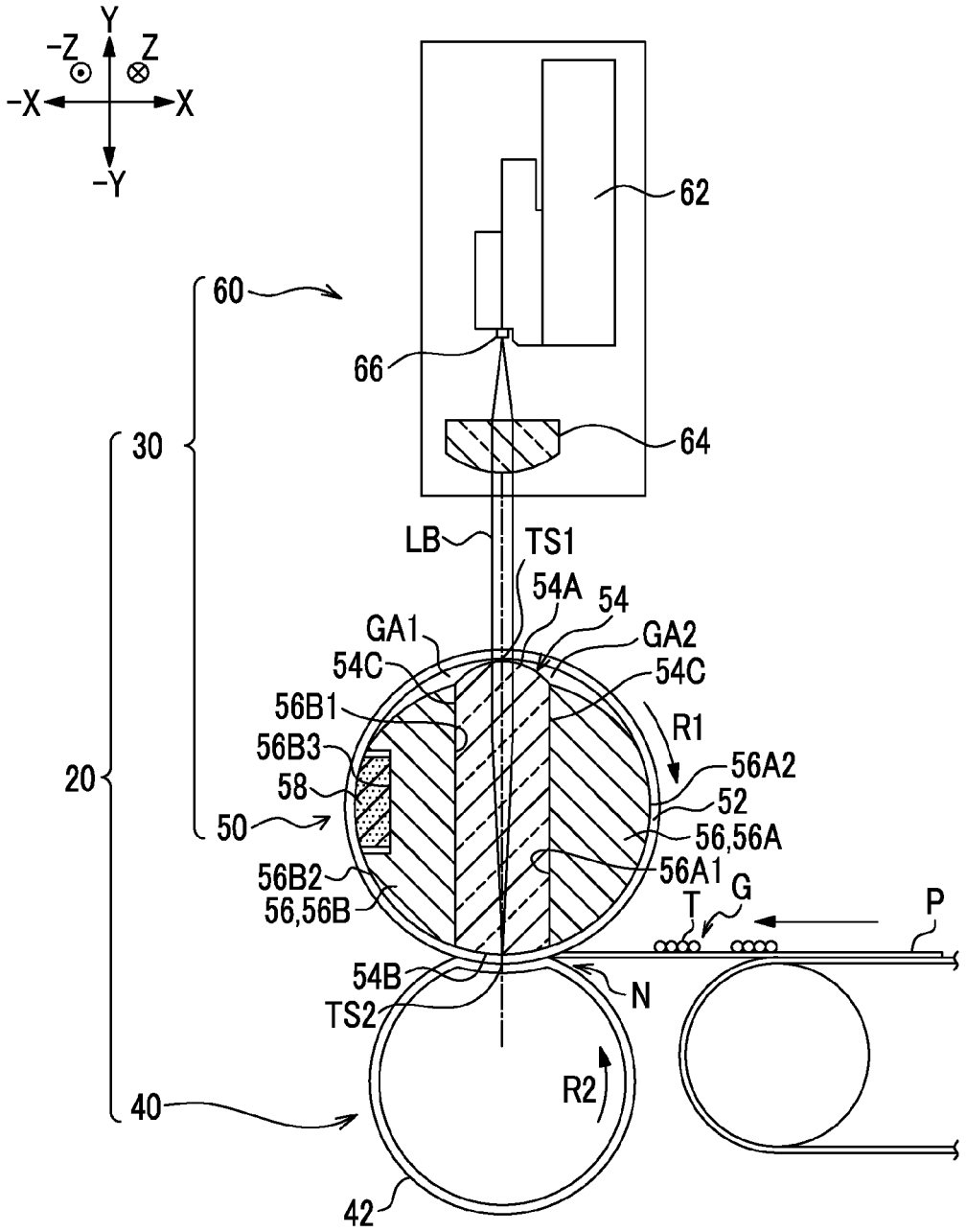
FIG. 2 is a schematic diagram (front view) showing a fixing device constituting the image forming apparatus according to the first exemplary embodiment.

As shown in FIG. 2, the fixing device 20 is configured to include a heating unit 30 and a pressure unit 40.

Heating Unit

The heating unit 30 has a function of heating the toner image G formed on the medium P by the toner image forming unit 14. The heating unit 30 includes a main member 50, and light irradiation units 60.

Main Member

The main member 50 includes a transparent belt 52, a cap (not shown), a gear (not shown), a lens 54, a guide unit 56, and a lubricating-liquid supply unit 58 (hereinafter, referred to as a supply unit 58).

Transparent Belt

The transparent belt 52 has a cylindrical shape and is disposed in a state in which an axis (a dashed line CL in FIG. 5) thereof is parallel with the apparatus depth direction. A cap (not shown) is fitted to the end of the transparent belt 52 on the front side in the apparatus depth direction, and a gear (not shown) is fitted to the end thereof on the back side in the apparatus depth direction. The gear (not shown) rotates around the axis (its own axis) by the driving source (not shown), and thus, the transparent belt 52 is caused to move through a predetermined path. Here, the predetermined path is referred to a path through which the transparent belt 52 in FIG. 2 rotates around the axis (in the direction of an arrow R1 in the drawing). In addition, the arrow R1 direction in the drawing means the movement direction of the transparent belt 52. A cylindrical member 42 to be described below rotates around an axis thereof, and thus, the transparent belt 52 rotates around the axis thereof along with the cylindrical member 42. The driving source has a function (function of supporting the driven rotation of the transparent belt 52 along with the cylindrical member 42) of driving the transparent belt 52 such that the transparent belt 52 and the cylindrical member 42 rotate at an equal speed. Thus, driving torque with which the driving source causes the transparent belt 52 to rotate is less than driving torque with which a driving source (not shown) that causes the cylindrical member 42 to rotate causes the cylindrical member 42 to rotate.

The transparent belt 52 is configured such that a part of light LB (laser beam) emitted from the light irradiation unit 60 to be described below is transmitted. In the present exemplary embodiment, the transmittance of the light LB output from the light irradiation unit 60 in the transparent belt 52 is, for example, 95% (Transmittance is the percentage of the light LB which passes through the transparent belt 52 and is output from an inner peripheral surface with respect to the light LB incident on an outer peripheral surface of the transparent belt 52.)

Figure 3:
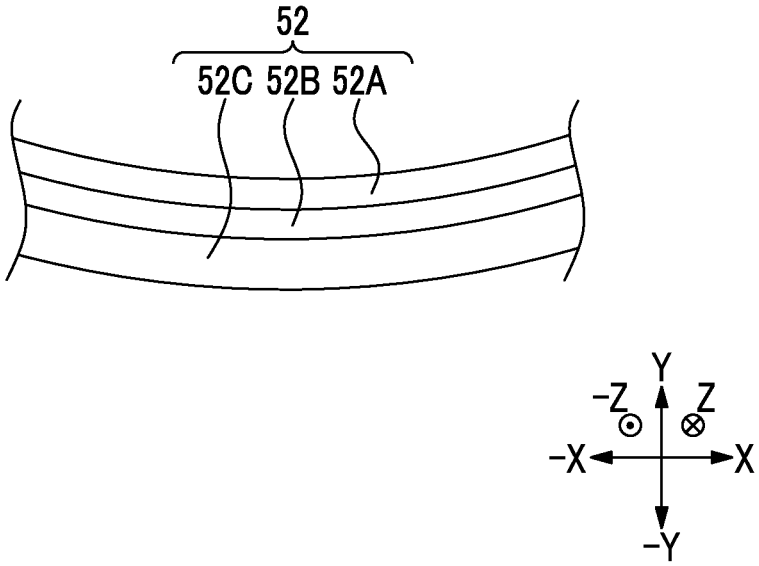
FIG. 3 is a partial sectional view showing a layer configuration of a transparent belt constituting the fixing device according to the first exemplary embodiment.

As shown in FIG. 3, the transparent belt 52 includes three layers including a base layer 52A, an elastic layer 52B laminated on the base layer 52A, and a release layer 52C laminated on the elastic layer 52B. The three layers are formed from the inner peripheral side to the outer peripheral side. The base layer 52A allows the transparent belt 52 to maintain necessary strength, the elastic layer 52B allows the transparent belt 52 to have properties of an elastic member, and the release layer 52C has a function of allowing the toner T heated on the medium P not to be offset on the transparent belt 52.

Lens

As shown in FIG. 2, the lens 54 has a function of concentrating the light LB incident to one end thereof at the other end thereof when viewed in the apparatus depth direction.

Figure 4:
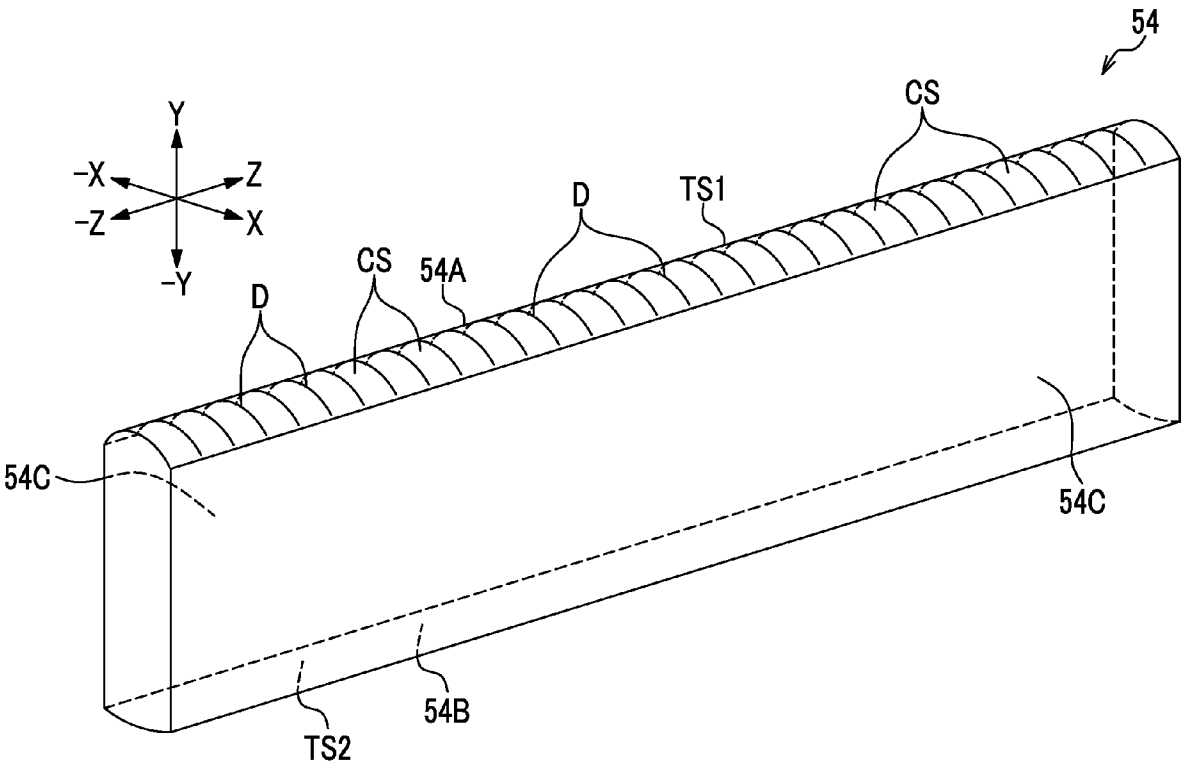
FIG. 4 is a schematic diagram (perspective view) showing a lens constituting the fixing device according to the first exemplary embodiment.

The lens 54 is disposed inside the transparent belt 52. As shown in FIG. 2 and FIG. 4, the lens 54 is long when viewed in the apparatus depth direction, and is disposed with a longitudinal direction thereof parallel to the apparatus height direction. As shown in FIG. 4, the lens 54 is long when viewed in the apparatus width direction, and is disposed with a longitudinal direction thereof parallel to the apparatus depth direction.

As shown in FIG. 2, a curved surface 54A is formed at an end (one end) of the lens 54 on the upper side in the apparatus height direction to protrude toward the upper side in the apparatus height direction when the lens 54 is viewed in the apparatus depth direction. The curved surface 54A has a top portion TS1 that is closest to the inner peripheral surface of the transparent belt 52, that is, the predetermined path through which the transparent belt 52 moves. The inner peripheral surface of the transparent belt 52 slides on a portion of the curved surface 54A having the top portion TS1 through silicone oil O to be described below. In other words, the curved surface 54A corresponds to a sliding surface on which the transparent belt 52 slides.

Figure 5:
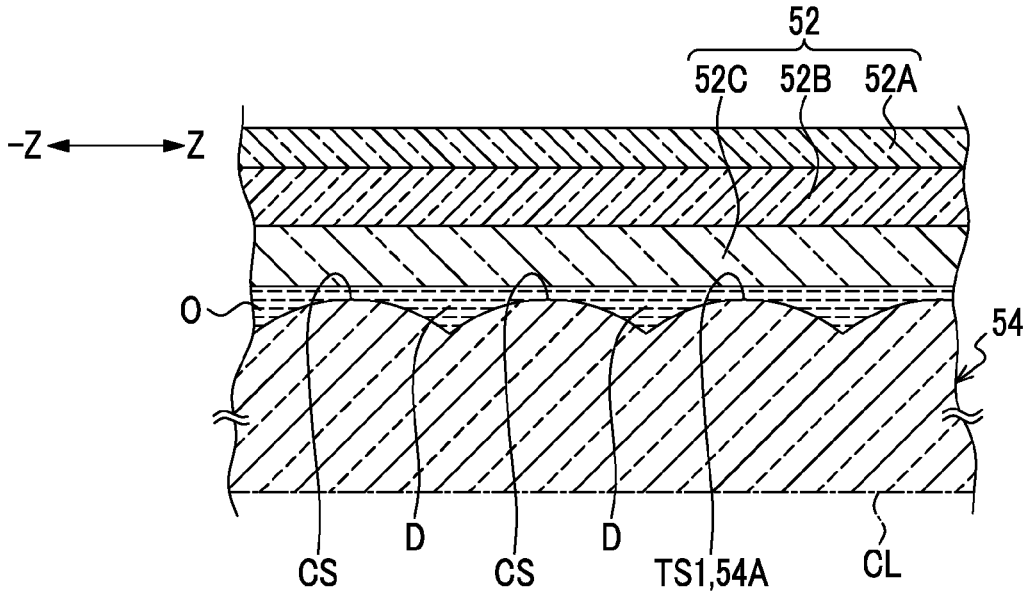
FIG. 5 is a schematic diagram (partial sectional view) showing a periphery of the top portion of the lens according to the first exemplary embodiment.

When the lens 54 is viewed in the apparatus height direction, as shown in FIG. 4, convex sections CS are formed on the curved surface 54A of the lens 54 from the upstream side to the downstream side in the movement direction of the transparent belt 52 With respect to the top portion TS1 and the convex section CS has a curved surface which protrudes toward the inner peripheral surface of the transparent belt 52. As shown in FIG. 5, each edge of the convex sections CS protrudes toward the inner peripheral surface side of the transparent belt 52 and forms a curved line having the top portion TS1 that is closest to the inner peripheral surface of the transparent belt 52 when viewed in a sectional plane taken along a virtual plane (Y-Z plane) including the entire top portions TS1 of the lens 54. The convex sections are continuously arranged in the apparatus depth direction.

As shown in FIG. 4 and FIG. 5, a groove D is formed between the top portions TS1 of the adjacent convex sections CS. The grooves D are arranged in the apparatus depth direction at an arrangement interval of the adjacent top portions TS1 based on a relationship with the convex sections CS described above. The grooves D are formed from the upstream side in the movement direction of the transparent belt 52 with respect to the top portion TS1 on the curved surface 54A to the downstream side with respect to the top portion TS1, in parallel with the movement direction of the transparent belt 52. A width of the convex section CS in the apparatus depth direction is from 50 μm to 5 mm and a height (distance from a boundary of the convex sections CS adjacent in the apparatus height direction to the top portion TS1 of the convex section CS) of the convex section CS is from 10 μm to 500 μm as an example. In the present exemplary embodiment, the width of the convex section CS in the apparatus depth direction is set as 100 μm as an example and the height of the convex section CS is set as 20 μm as an example.

As shown in FIG. 2, a curved surface 54B is formed at an end (the other end) of the lens 54 on the lower side in the apparatus height direction to protrude toward the lower side in the apparatus height direction. The transparent belt 52 is wound on the curved surface 54B of the lens 54 through the silicone oil O. Curvature of the curved surface 54A is greater than curvature of the curved surface 54B. Planar surfaces 54C are formed parallel with the apparatus height direction at both ends of the lens 54 in a transverse direction when viewed in the apparatus depth direction.

When viewed in the apparatus depth direction, the lens 54 is symmetric with respect to a straight imaginary line (a dashed line in the drawing) which passes through the top portion TS1 and is parallel to the apparatus height direction.

In such a configuration, when viewed in the apparatus depth direction, the lens 54 is configured to concentrate the light LB incident on the curved surface 54A on a central portion TS2 (indicating an overlapped portion with the dashed line in the drawing) of the curved surface 54B by using the apparatus height direction as a traveling direction.

Guide Unit

As shown in FIG. 2, the guide unit 56 has a function of supporting the lens 54 while sandwiching the lens from both sides in the apparatus width direction, and a function of guiding the transparent belt 52 that rotates around the axis such that the transparent belt rotates while maintaining a cylindrical shape. The guide unit 56 includes a first guide section 56A, and a second guide section 56B. Both the first guide section 56A and the second guide section 56B are long, and are arranged inside the transparent belt 52 with longitudinal directions thereof parallel to the apparatus depth direction.

When viewed in the apparatus depth direction, a planar surface 56A1 parallel with the apparatus height direction is formed on one side (a side of the −X direction) of the first guide section 56A in the apparatus width direction. When viewed in the apparatus depth direction, a gently curved surface 56A2 that protrudes toward the other side in the apparatus depth direction is formed on the other side of the first guide section 56A in the apparatus width direction (a side of the X direction).

When viewed in the apparatus depth direction, a gently curved surface 56B2 that protrudes toward the one side in the apparatus depth direction is formed on one side of the second guide section 56B in the apparatus width direction. When viewed in the apparatus depth direction, a planar surface 56B1 parallel with the apparatus height direction is formed on the other side of the second guide section 56B in the apparatus width direction. A concave portion 56B3 that is opened in one side in the apparatus width direction is formed over the entire region of the gently curved surface 56B2 in the apparatus depth direction. The supply unit 58 to be described below is accommodated in the concave portion 56B3.

The widths of the planar surface 56A1 and the planar surface 56B1 in the transverse direction are equal to the widths of the planar surfaces 54C of the lens 54 in the transverse direction. The guide unit 56 supports the lens 54 while the entire region of the planar surface 56A1 of the first guide section 56A is overlapped with the entire region of the planar surface 54C on the other side of the lens 54 in the apparatus width direction and the entire region of the planar surface 56B1 of the second guide section 56B is overlapped with the entire region of the planar surface 54C on one side of the lens 54 in the apparatus width direction.

The curvatures of the gently curved surface 56A2 of the first guide section 56A and the gently curved surface 56B2 of the second guide section 56B are smaller than the curvature of the curved surface 54A of the lens 54. For this reason, when viewed in the apparatus depth direction, a boundary between the gently curved surface 56A2 and the curved surface 54A and a boundary between the gently curved surface 56B2 and the curved surface 54A are connected as a discontinuous curved surface. In contrast, the curvatures of the gently curved surface 56A2 of the first guide section 56A and the gently curved surface 56B2 of the second guide section 56B are equal to the curvature of the curved surface 54B of the lens 54. Thus, when viewed in the apparatus depth direction, a boundary between the gently curved surface 56A2 and the curved surface 54B and a boundary between the gently curved surface 56B2 and the curved surface 54B are connected as a continuous curved surface.

Supply Unit

The supply unit 58 has a function of supplying silicone oil O (see FIGS. 7 and 8) to the inner peripheral surface of the transparent belt 52. Here, the silicone oil O is an example of a lubricating liquid. The silicone oil O is used to improve the slippage of the transparent belt 52 (to reduce friction) with respect to the curved surface 54B of the lens 54 by being provided between the curved surface 54B of the lens 54 and the inner peripheral surface of the transparent belt 52 that rotates around the axis. The silicone oil O may transmit the light LB.

The supply unit 58 is long. As shown in FIG. 2, the supply unit 58 is accommodated within the concave portion 56B3 formed in the second guide section 56B while the longitudinal direction thereof is parallel to the apparatus depth direction and a part thereof protrudes. The part of the supply unit 58 protruding from the concave portion 56B3 is in contact with the inner peripheral surface of the transparent belt 52. The supply unit 58 according to the present exemplary embodiment is made of, for example, a felt material, and the felt material is impregnated with the silicone oil O. Thus, the supply unit 58 is configured to supply the impregnated silicone oil O to a portion of the inner peripheral surface of the transparent belt 52 coming in contact with the supply unit 58. As a result, the transparent belt 52 rotates around the axis, and thus, the silicone oil O impregnated in the supply unit 58 is supplied to the entire inner peripheral surface of the transparent belt 52.

Light Irradiation Unit

Figure 6:
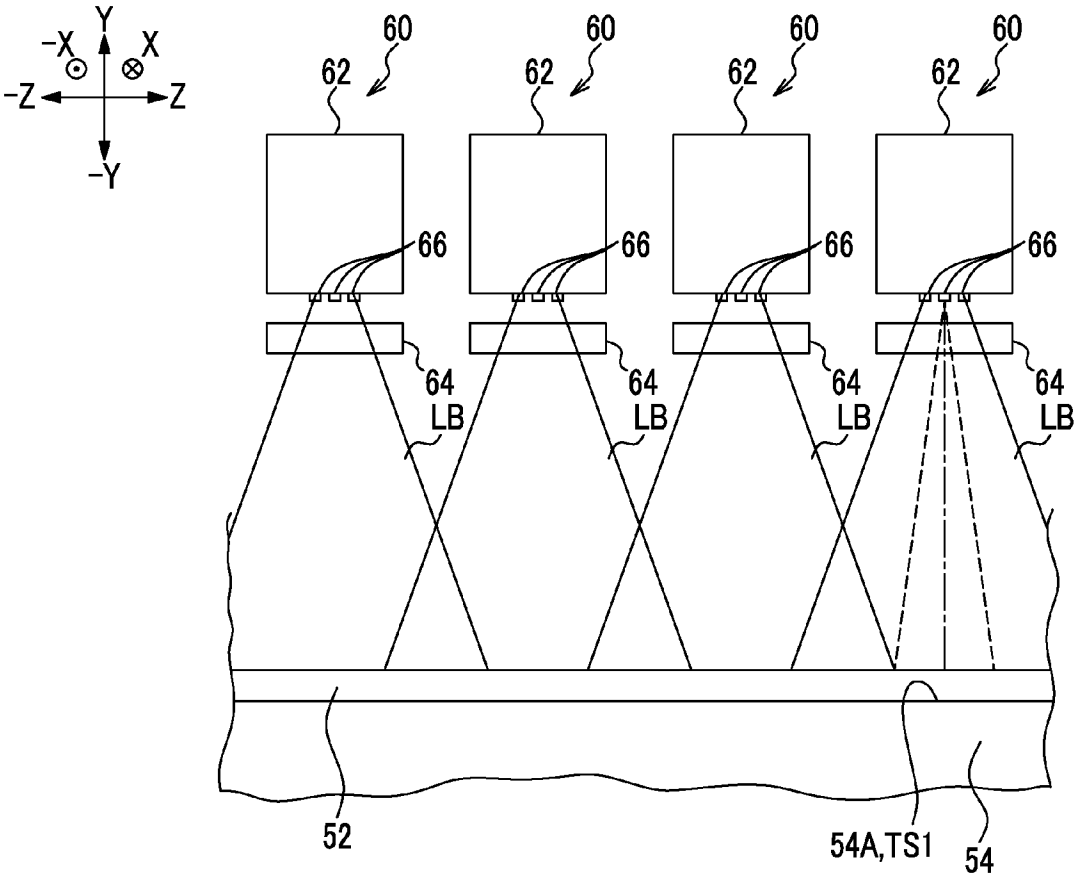
FIG. 6 is a schematic diagram (side view) showing a state in which a light irradiation unit constituting the fixing device according to the first exemplary embodiment irradiates the transparent belt with light.

The light irradiation unit 60 has a function of applying the light LB for heating the toner image G formed on the medium P. As shown in FIGS. 2 and 6, the light irradiation unit 60 includes a laser array 62, and a collimating lens 64. In the heating unit 30 according to the present exemplary embodiment, the plural light irradiation units 60 are arranged in the apparatus depth direction. The respective light irradiation units 60 are arranged on the upper side of the transparent belt 52. Each laser array 62 includes plural light sources 66 arranged in the apparatus depth direction.

As shown in FIG. 2, the light source 66 causes the light LB traveling parallel to the apparatus height direction to be incident to a portion of the outer peripheral surface of the transparent belt 52, which faces the top portion TS1 of the lens 54 when viewed in the apparatus depth direction. Specifically, the light source 66 is disposed at a position at which a light axis (a dashed line in the drawings) of the light LB is overlapped with the top portion TS1 of the lens 54 when viewed in the apparatus depth direction.

As shown in FIG. 6, the light source 66 causes the light LB (a dashed line in the drawings) traveling in the apparatus height direction and the light LB (a dotted line in the drawings) traveling in a direction inclined with respect to the apparatus height direction to be incident to the outer peripheral surface of the transparent belt 52 when viewed in the apparatus width direction. Here, the direction inclined with respect to the apparatus height direction is a direction inclined with respect to the axis of the transparent belt 52. The respective light irradiation units 60 are arranged such that the light LB from the light source 66 of one light irradiation unit 60 of adjacent light irradiation units 60 and the light LB from the light source 66 of the other light irradiation unit 60 are overlapped with each other and are incident to the outer peripheral surface of the transparent belt 52.

Pressure Unit

As shown in FIG. 2, the pressure unit 40 has a function of forming a nip N by cooperating with the transparent belt 52 coming in contact with the outer peripheral surface of the transparent belt 52 on a side opposite to the curved surface 54B of the lens 54 with the transparent belt 52 interposed therebetween. The pressure unit 40 has a function of pressurizing the toner image G on the medium P transported to the nip N by cooperating with the transparent belt 52.

The pressure unit 40 includes the cylindrical member 42, the cap (not shown), and the gear (not shown). The cylindrical member 42 is disposed in the apparatus depth direction. The cap (not shown) is fitted to the end of the cylindrical member 42 on the front side in the apparatus depth direction, and the gear (not shown) is fitted to the end thereof on the back side in the apparatus depth direction. The gear (not shown) rotates around the axis (its own axis) by the driving source (not shown), and thus, the cylindrical member 42 rotates around the axis (in the direction of the arrow R2 in the drawing).

The cylindrical member 42 may be deformed, and forms the nip N that nips the transparent belt 52 coming in contact with a portion opposite to the curved surface 54B of the lens 54 with the transparent belt 52 interposed therebetween. The nip N is formed so as to have the portion of the outer peripheral surface of the transparent belt 52 facing the central portion TS2 of the curved surface 54B. Thus, the light LB applied by the light source 66 is concentrated on the portion of the cylindrical member 42 that pressurizes the medium P.

Supplement

In the above-mentioned description, the configuration of the fixing device 20 has been described for the respective components of the fixing device 20. Here, a relationship between the components of the fixing device 20 will be further described.

Supplement 1

As stated above, the top portion TS1 of the curved surface 54A of the lens 54 is closest to the inner peripheral surface of the transparent belt 52. From a different perspective, gaps are formed between the inner peripheral surface of the transparent belt 52 and the portions of the curved surface 54A other than the top portion TS1. Here, as shown in FIG. 2, the gap on the upstream side of the transparent belt 52 in the rotation direction with respect to the portion of the transparent belt 52 facing the top portion TS1 is referred to as a gap GA1, and the gap on the downstream side of the transparent belt 52 in the rotation direction with respect to the portion of the transparent belt facing the top portion is referred to as a gap GA2.

Supplement 2

As described above, the silicone oil O impregnated in the supply unit 58 is supplied to the entire inner peripheral surface of the transparent belt 52 by the rotation of the transparent belt 52 around the axis. Thus, the transparent belt 52 moves through the predetermined path while the silicone oil O adheres to the inner peripheral surface of the transparent belt 52. In addition, in a state in which the silicone oil O adheres to the inner peripheral surface of the transparent belt 52, the transparent belt 52 moves through the predetermined path and thereby, the silicone oil O adheres to the curved surface 54A of the lens 54.

Supplement 3

From a different perspective regarding the lens 54, the lens 54 concentrates the light LB, which is transmitted through the transparent belt 52 moving through the predetermined path, and is incident to the other end side from the one end side. The sliding surface, on which the transparent belt 52 slides through a lubricating liquid O, corresponds to the curved surface 54A having the top portion TS1 that is closest to the path and the groove D is formed on the sliding surface.

The configuration of the fixing device 20 and the configuration of the image forming apparatus 10 according to the present exemplary embodiment have been described.

Operation of Image Forming Apparatus

Next, the operation of the image forming apparatus 10 according to the present exemplary embodiment will be described with reference to the drawings.

When receiving an image forming instruction, the control unit 16 operates the transport unit 12, the toner image forming unit 14 and the fixing device 20. In this case, in the toner image forming unit 14, the toner image G is formed on the medium P transported by the transport unit 12 by performing the processes such as charging, exposing, developing, and transferring. The medium P on which the toner image G has been formed is transported toward the fixing device 20 by the transport unit 12. The medium P on which the toner image G has been formed passes through the nip N formed with the transparent belt 52 and the cylindrical member 42 of the fixing device 20. In this case, the toner image G on the medium P is pressurized by the cylindrical member 42. As stated above, since the light LB output from the light source 66 is concentrated on the portion of the medium P pressurized by the cylindrical member 42, the toner image G on the medium P is heated by the light LB concentrated on the curved surface 54B of the lens 54 for a partial period of a period during which the toner image passes through the nip N. Thus, the toner image G on the medium P passed through the nip N is fixed on the medium P. The medium P on which the toner image G has been fixed is discharged to the outside of the image forming apparatus 10, and the operation of the image forming apparatus 10 is ended.

The operation of the image forming apparatus 10 has been described.

Effect

Next, the effects of the present exemplary embodiment will be described with reference to the drawings.

Hereinafter, effects obtained based on the grooves D formed on the curved surface 54A of the lens 54 of the present exemplary embodiment will be described. Here, the effects of the present exemplary embodiment are described based on a comparison between the present exemplary embodiment and a comparative embodiment to be described below. According to the comparative embodiment, in a case where the same components as in the image forming apparatus 10 of the present exemplary embodiment are used, description is provided by attaching the same reference signs or the like to the components or the like.

Effects Based on Grooves Formed on Sliding Surface on Lens for Transparent Belt

Figure 7:
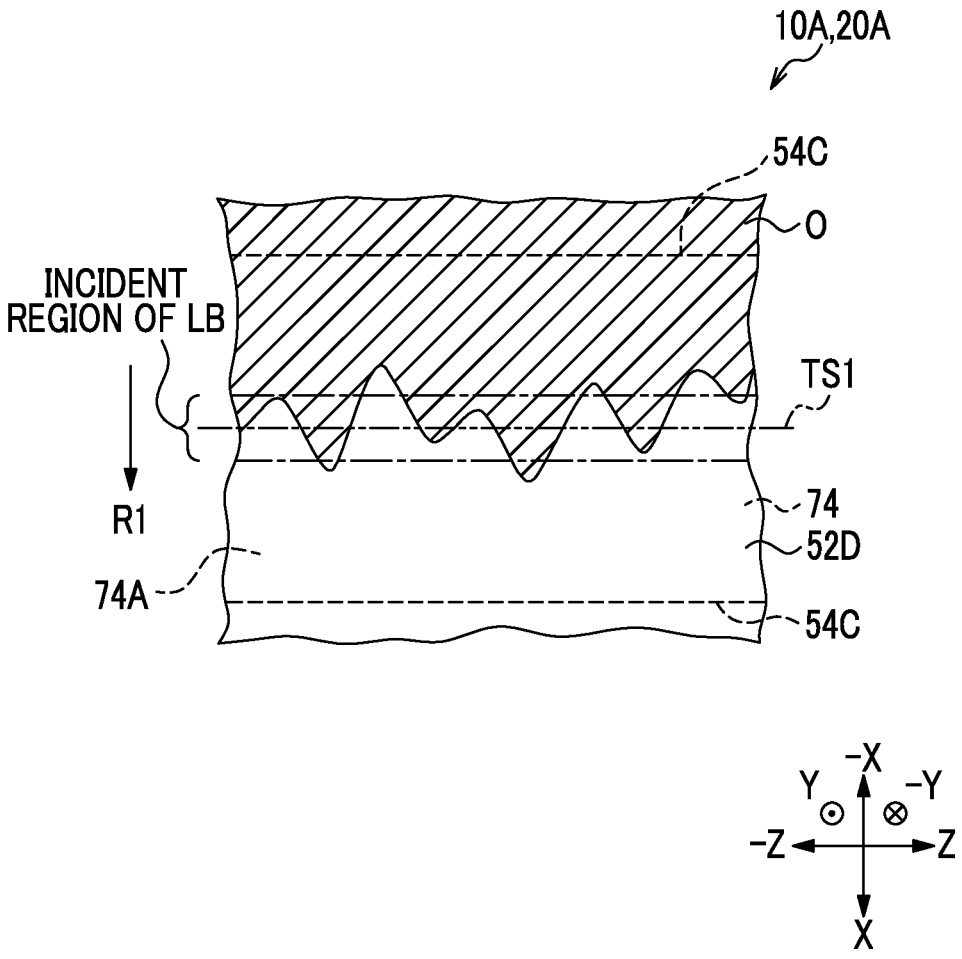
FIG. 7 is a through-view showing the transparent belt in a fixing device according to a comparative embodiment from above and a view schematically showing a state in which oil reaches and unevenly adheres to a portion of the transparent belt to which light is incident and to the vicinity of the top portion of the lens.
Figure 9:
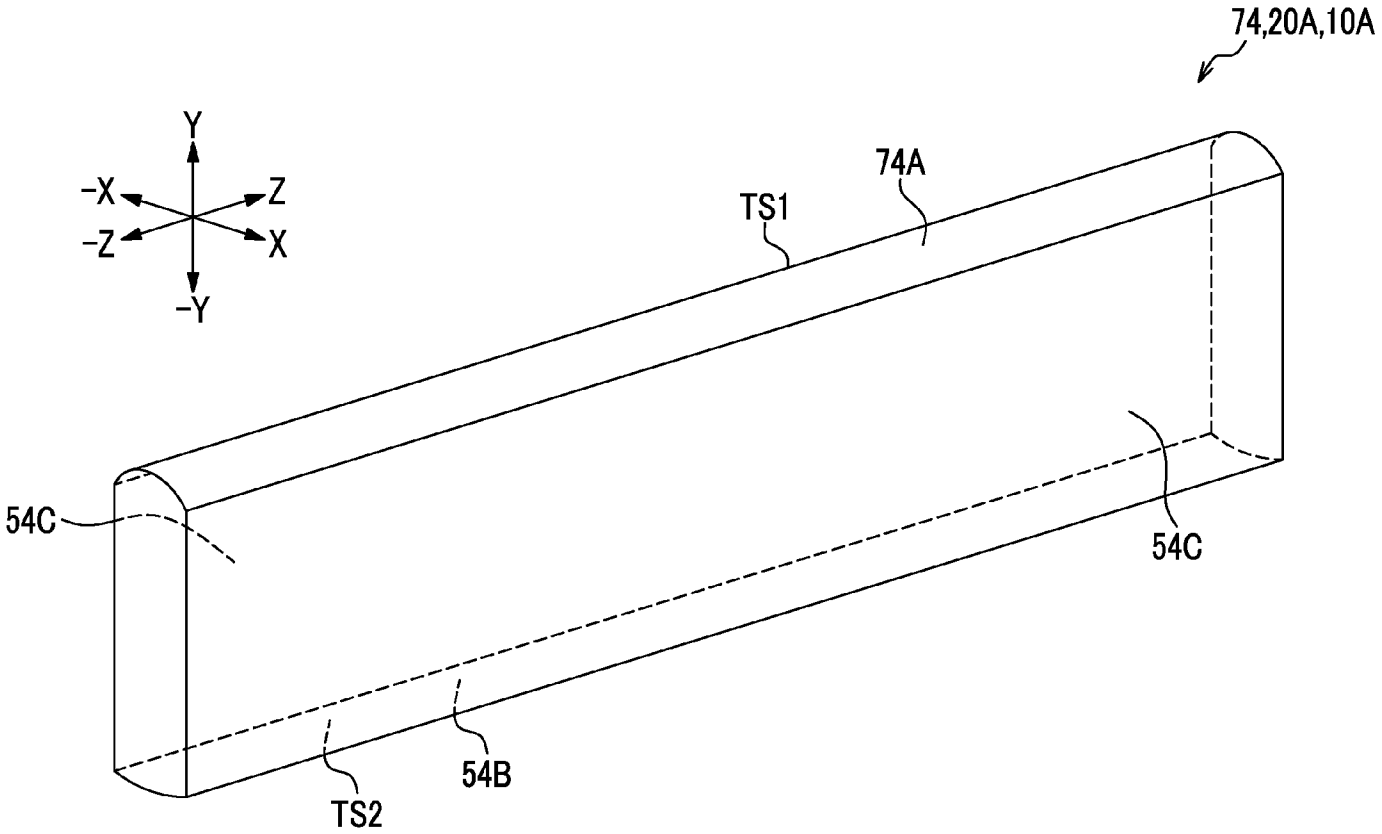
FIG. 9 is a schematic diagram (perspective view) showing a lens constituting the fixing device according to a comparative embodiment.

As shown in FIG. 7 and FIG. 9, no grooves D are formed on a curved surface 74A (surface to which the light LB is incident) on the one end side of a lens 74 of the comparative embodiment. Except for this point, the lens 74 of the comparative embodiment has the same configuration as the lens 54 of the present exemplary embodiment. A fixing device 20A of the comparative embodiment has the same configuration as the fixing device 20 of the present exemplary embodiment except that the fixing device 20A includes the lens 74 instead of the lens 54 of the present exemplary embodiment. An image forming apparatus 10A of the comparative embodiment has the same configuration as the image forming apparatus 10 of the present exemplary embodiment except that the image forming apparatus 10A includes the fixing device 20A of the comparative embodiment instead of the fixing device 20 of the present exemplary embodiment.

As stated above, the fixing device 20A of the comparative embodiment includes the lens 74 instead of the lens 54 of the present exemplary embodiment. In this manner, the fixing device 20A has a configuration in which the top portion TS1 of the curved surface 54A of the lens 54 becomes closest to the inner peripheral surface of the transparent belt 52. Thus, in the fixing device 20A, the rotation of the transparent belt 52 causes the silicone oil O to reach the vicinity of the top portion TS1; however, it is difficult, for the silicone oil O to move beyond the top portion TS1 due to a relationship between adhesion of the silicone oil O to the transparent belt 52 and a narrow distance between the top portion TS1 and the transparent belt 52, or the like. In this manner, as shown in FIG. 7, the silicone oil O unevenly adheres to the top portion TS1 of the lens 74 in the apparatus depth direction (an irradiation width direction of the light LB) in some cases.

In this case, after the light LB incident to the curved surface 54A is transmitted through the transparent belt 52 in a state in which the light axis is overlapped with the top portion TS1 of the lens 74, both the light LB incident through the silicone oil O and the light LB incident not through the silicone oil O but through an air layer are produced together. Thus, in a case of the fixing device 20A of the comparative embodiment, the light LB reaching the entire irradiation width of the light LB on the curved surface 54B is variably concentrated in the axial direction of the transparent belt due to a difference in absorptivity of the silicone oil O and the air layer with respect to the light LB.

Figure 8:
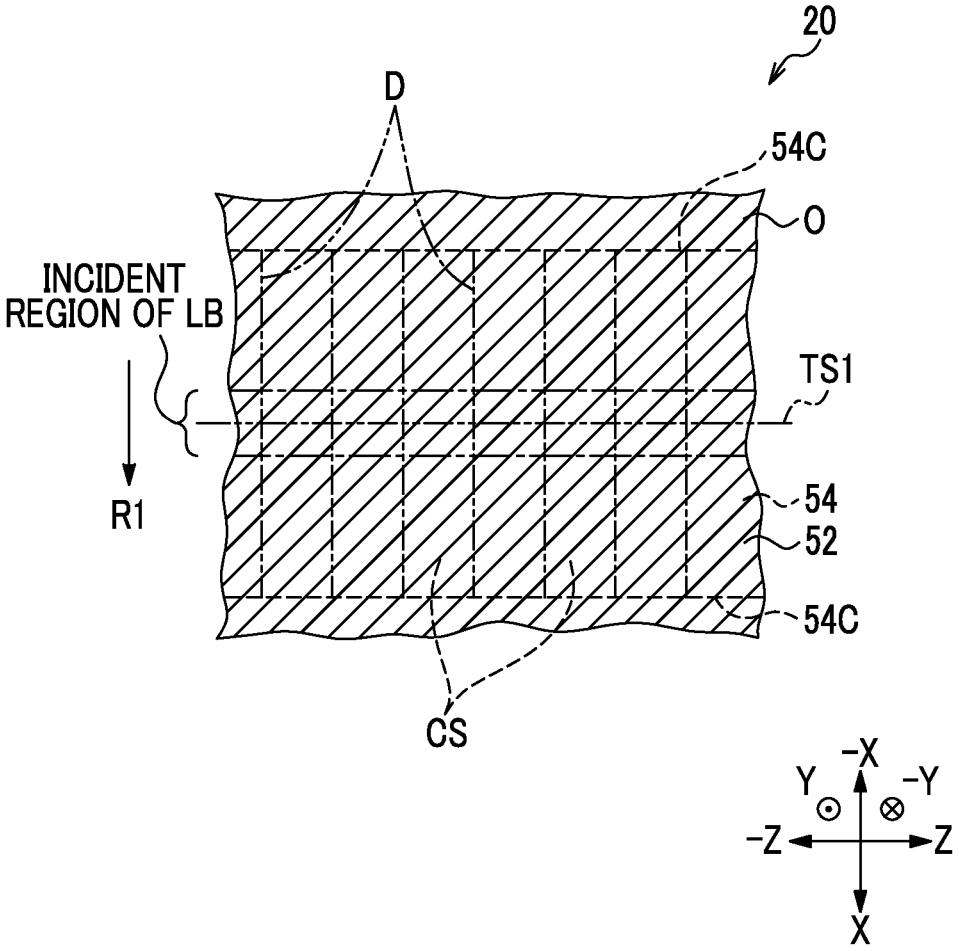
FIG. 8 is a through-view showing the transparent belt in the fixing device according to the first exemplary embodiment from above and a view schematically showing a state in which the oil reaches a portion of the transparent belt to which light is incident and the vicinity of the top portion of the lens, passes the top portion, and evenly adheres thereto.

In contrast, as shown in FIG. 4, FIG. 5, and FIG. 8, the lens 54 of the present exemplary embodiment has the curved surface 54A on which the grooves D are formed on a portion on which the transparent belt 52 slides. That is, as shown in FIG. 5, in the fixing device 20 of the present exemplary embodiment, a distance between the top portion TS1 and the transparent belt 52 is wider at the portion in which the grooves D are formed than in the fixing device 20A of the comparative embodiment. Thus, in the present exemplary embodiment compared to the comparative embodiment (comparing FIG. 7 with FIG. 8), the silicone oil O supplied to the inner peripheral surface of the transparent belt 52 from the supply unit 58 reaches the vicinity of the top portion TS1, then flows into the grooves D and thereby, easily moves to the top portion TS1 and to a portion beyond the top portion TS1. As a result, in the present exemplary embodiment compared to the comparative embodiment, it is difficult for the silicone oil O to unevenly adhere to the top portion TS1 of the lens 54 in the apparatus depth direction (irradiation width direction of the light LB).

Therefore, according to the lens 54 of the present exemplary embodiment compared to the lens 74 of the comparative embodiment, it is possible to suppress concentration variation of the light LB in the axial direction of the transparent belt 52, which is incident to the other end side from the one end side of the lens 54 through the transparent belt 52, on the other end side. According to the fixing device 20 of the present exemplary embodiment compared to the fixing device 20A of the comparative embodiment, it is possible to prevent a fixing defect due to the concentration variation of the light LB in the axial direction of the transparent belt 52. In addition, according to the image forming apparatus 10 of the present exemplary embodiment compared to the image forming apparatus 10A of the comparative embodiment, it is possible to prevent an image forming defect due to the above fixing defect.

Effect of Groove Formed in Parallel with Movement Direction of Transparent Belt

As shown in FIG. 7 and FIG. 9, no grooves D are formed on the curved surface 74A (surface to which the light LB is incident) on the one end side of the lens 74 of the comparative embodiment. As above, as shown in FIG. 7, the silicone oil O unevenly adheres to the top portion TS1 of the lens 74 in the apparatus depth direction (irradiation width direction of the light LB) in some cases. Thus, in a case of the fixing device 20A of the comparative embodiment, the light LB reaching the entire irradiation width of the light LB on the curved surface 54B is variably concentrated in the axial direction of the transparent belt due to a difference in absorptivity of the silicone oil O and the air layer with respect to the light LB.

In contrast, as shown in FIG. 4 and FIG. 8, the grooves D on the lens 54 of the present exemplary embodiment are formed parallel to the movement direction of the transparent belt 52. Thus, the silicone oil O which adheres to the inner peripheral surface of the transparent belt 52 is easily transported in a transport direction by the transparent belt 52, compared to the case of the fixing device of the comparative embodiment. As a result, in the case of the fixing device 20 of the present exemplary embodiment, the silicone oil O easily reaches the top portion TS1 and a portion beyond the top portion TS1.

Therefore, in the lens 54 of the present exemplary embodiment compared to the lens of the comparative embodiment, it is possible to suppress concentration variation of the light LB in the axial direction of the transparent belt 52, which is incident to the other end side from the one end side of the lens 54 through the transparent belt 52, on the other end side. According to the fixing device 20 of the present exemplary embodiment compared to the fixing device of the comparative embodiment, it is possible to prevent a fixing defect due to the concentration variation of the light LB in the axial direction of the transparent belt 52. In addition, according to the image forming apparatus 10 of the present exemplary embodiment compared to the image forming apparatus of the comparative embodiment, it is possible to prevent an image forming defect due to the above fixing defect.

Second Exemplary Embodiment

Figure 10:
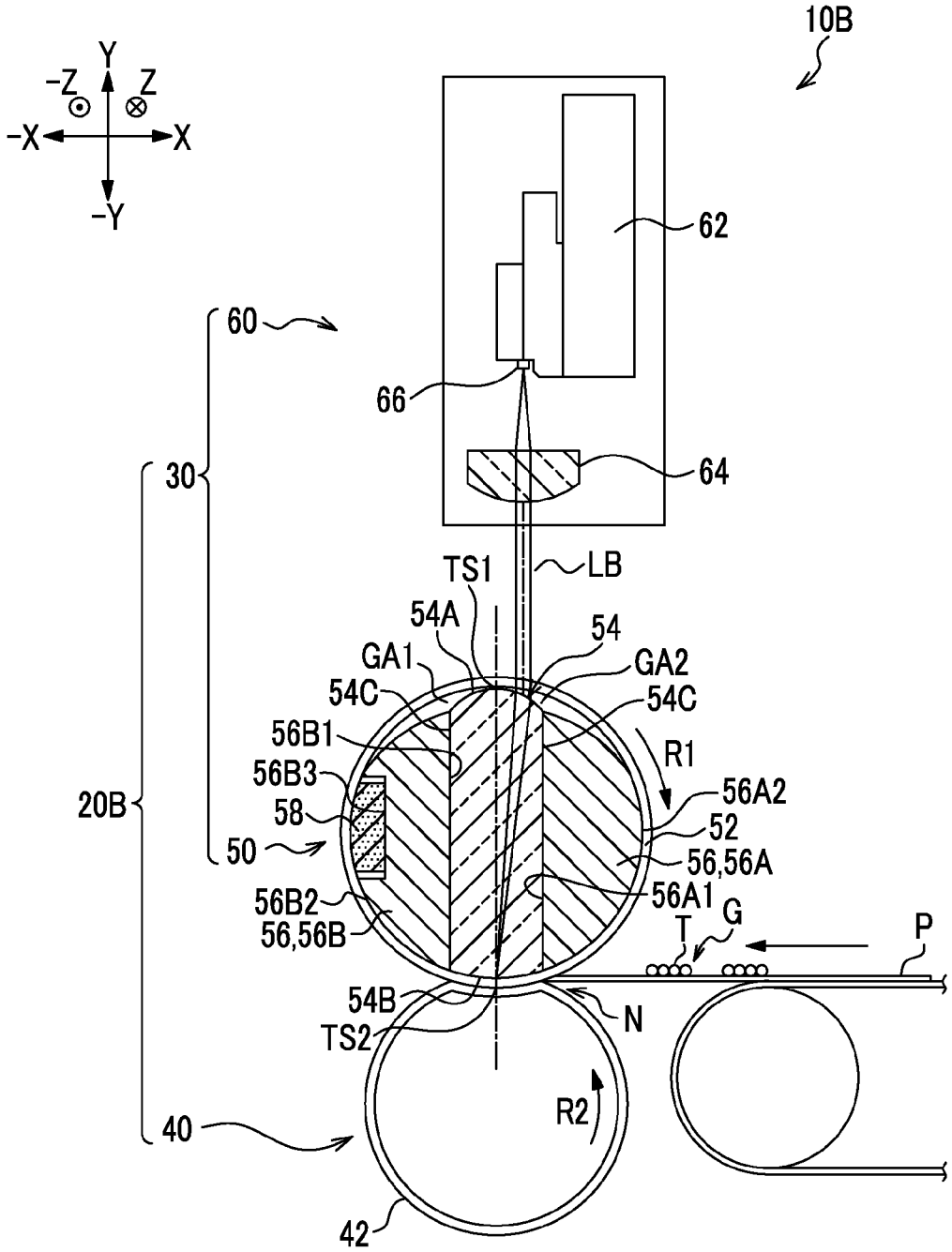
FIG. 10 is a schematic diagram (front view) showing a fixing device constituting an image forming apparatus according to a second exemplary embodiment.

Next, a fixing device 20B of a second exemplary embodiment will be described with reference to FIG. 10. According to the present exemplary embodiment, in a case where the same components as in the image forming apparatus 10 of the first exemplary embodiment are used, description is provided by attaching the same reference signs or the like to the components or the like.

Configuration

The fixing device 20B of the present exemplary embodiment is different from the fixing device 20 of the first exemplary embodiment in disposition of the main member 50 of the light irradiation unit 60. Specifically, the light irradiation unit 60 is disposed at a position shifted on the downstream side (one side in the apparatus width direction) in the movement direction of the transparent belt 52 from the top portion TS1 of the lens 54 when viewed in the apparatus depth direction. Thus, the light source 66 causes the light LB traveling along the apparatus height direction to be incident to a position which is overlapped with the curved surface 54A of the lens 54 on the downstream side of the transparent belt 52 in the movement direction from the portion of the outer peripheral surface of the transparent belt 52, which faces the top portion TS1 of the lens 54. Except for this point, the fixing device 20B of the present exemplary embodiment has the same configuration as the fixing device 20 of the first exemplary embodiment. In addition, an image forming apparatus 10B of the present exemplary embodiment has the same configuration as the image forming apparatus 10 of the first exemplary embodiment except that the image forming apparatus 10B includes the fixing device 20B of the present exemplary embodiment instead of the fixing device 20 of the first exemplary embodiment.

Effects

Figure 11:
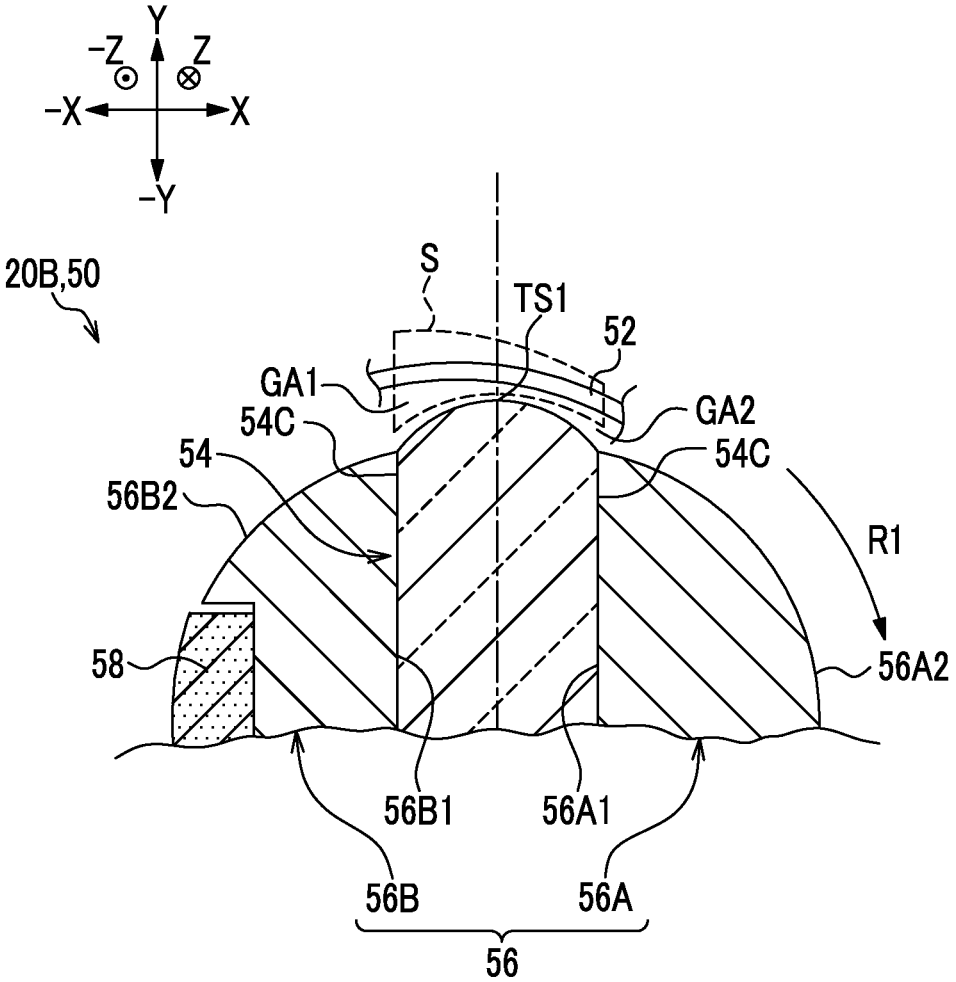
FIG. 11 is a schematic diagram (front view) showing a part of a heating unit constituting the fixing device according to the second exemplary embodiment and a diagram in which a portion surrounded with a dotted line shows a vibration magnitude of the transparent belt in a vertical direction when the transparent belt rotates around an axis thereof.

In the fixing device 20B of the present exemplary embodiment, the transparent belt 52 rotates around its own axis while a portion thereof which faces the curved surface 54A vertically vibrates. Observation of the fixing device 20B of the present exemplary embodiment enables confirmation that, as shown in FIG. 11, a vertical magnitude of the vibration of the transparent belt 52 is gradually decreased as the portion facing the curved surface 54A of the lens 54 moves from the upstream side in the rotating direction toward the downstream side in the rotating direction. A portion S enclosed by a broken line in FIG. 11 shows an enlarged vibration magnitude of the portion of the rotating transparent belt 52, which faces the curved surface 54A when viewed in the axial direction of the transparent belt 52. A mechanism of how the transparent belt 52 has the vertical magnitude of the vibration as shown in FIG. 11 is assumed as follows. That is, the transparent belt 52 rotates around the axis along with the nip N in the cylindrical member 42. Here, for convenience, the rotating transparent belt 52 is divided into a portion (hereinafter, referred to as a first portion) from the portion facing the top portion TS1 to the nip N and a portion (hereinafter, referred to as a second portion) from the nip N to the portion facing the top portion TS1, in the movement direction. In this manner, it is considered that the first portion is a portion which is pulled by the nip N and the second portion is a portion which is pushed by the nip N. That is, the first portion is more stretched in the rotating direction of the transparent belt 52 than the second portion. From a different perspective, the transparent belt 52 of the second portion is more loosened than the first portion. Thus, the first portion has a smaller vertical magnitude of the vibration than the second portion. Since the top portion TS1 is positioned at a central portion between the first portion and the second portion, it is assumed that the vertical magnitude of the vibration of the portion of the transparent belt 52, which faces the top portion TS1 is smaller than that of the second portion and is greater than that of the first portion.

When the light LB that is transmitted through the vertically vibrating transparent belt 52 is incident to the curved surface 54A of the lens 54, the light reaching the other end of the lens is concentrated to have an uneven intensity (light intensity) with respect to time (light concentration variation depending on a time).

As stated above, the light source 66 of the fixing device 20B of the present exemplary embodiment causes the light LB to be incident to a portion on the downstream side in the rotating direction with respect to the portion facing the top portion TS1 in a portion of the transparent belt 52, which faces the curved surface 54A. Thus, the light LB from the light source 66 of the fixing device 20B of the present exemplary embodiment is incident to a portion where the magnitude of the vibration of the transparent belt 52 is small compared to the light LB from the light source 66 of the fixing device 20 of the first exemplary embodiment.

Therefore, according to the fixing device 20B of the present exemplary embodiment compared to the fixing device 20 of the first exemplary embodiment, it is possible to prevent the fixing defect due to the concentration variation of the light LB depending on a time. Accordingly, according to the image forming apparatus 10B of the present exemplary embodiment compared to the image forming apparatus 10 of the first exemplary embodiment, it is possible to prevent image forming defect due to the above fixing defect.

Third Exemplary Embodiment

Next, a fixing device 20C of a third exemplary embodiment will be described with reference to FIG. 12. According to the present exemplary embodiment, in a case where the same components as in the image forming apparatus 10 of the first exemplary embodiment are used, description is provided by attaching the same reference signs or the like to the components or the like.

Configuration

Figure 12:
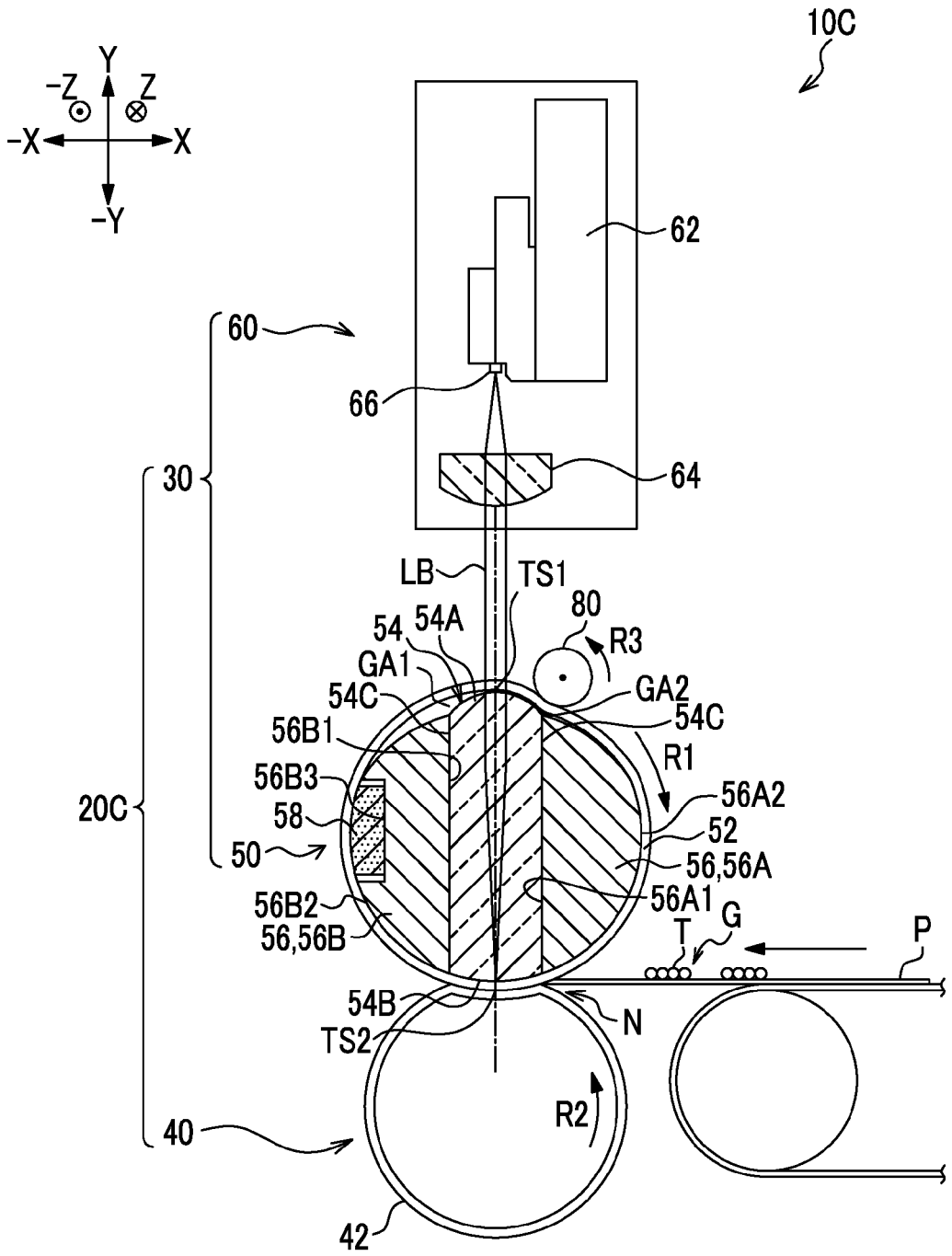
FIG. 12 is a schematic diagram (front view) showing a fixing device constituting an image forming apparatus according to a third exemplary embodiment.

As shown in FIG. 12, the fixing device 20C of the present exemplary embodiment includes a pushing member 80 that presses the outer peripheral surface of the transparent belt 52 and pushes the inner peripheral surface of the transparent belt 52 against a portion on the curved surface 54A of the lens 54 on the downstream side in the rotating direction of the transparent belt 52 from the top portion TS1. Except for this point, the fixing device 20C of the present exemplary embodiment has the same configuration as the fixing device 20 of the first exemplary embodiment. In addition, the image forming apparatus 10C of the present exemplary embodiment has the same configuration as the image forming apparatus 10 of the first exemplary embodiment except that the image forming apparatus 10C includes the fixing device 20C of the present exemplary embodiment.

The pushing member 80 is a long roll that may rotate around an axis. The pushing member 80 is disposed with the axial direction thereof parallel to the apparatus depth direction. The transparent belt 52 rotates, and thus, the pushing member 80 rotates in the direction represented by an arrow R3 along with the rotation of the transparent belt 52. The pushing member 80 pushes the inner peripheral surface of the transparent belt 52 toward the portion of the curved surface 54A of the lens 54 on the downstream side of the transparent belt 52 from the top portion TS1 in the rotation direction, and thus, the gap GA2 is formed so as to have a smaller size than that in the fixing device 20 according to the first exemplary embodiment.

Effects

As stated above, in a case of the fixing device 20C of the present exemplary embodiment, the pushing member 80 pushes the transparent belt 52 against the portion on the curved surface 54A of the lens 54 on the downstream side in the rotating direction of the transparent belt 52 from the top portion TS1. From a different perspective, the transparent belt 52 is wound on at least the portion to which the light LB is incident, in the portion on the curved surface 54A of the lens 54 on the downstream side in the rotating direction of the transparent belt 52 from the top portion TS1. Thus, in the fixing device 20C of the present exemplary embodiment compared to the fixing device 20 of the first exemplary embodiment, the vertical magnitude of the vibration of the portion of the rotating transparent belt 52, which faces the curved surface 54A is small.

Therefore, according to the fixing device 20C of the present exemplary embodiment compared to the fixing device 20 of the first exemplary embodiment, it is possible to prevent the fixing defect due to the concentration defect of the light with respect to a position. Accordingly, according to the image forming apparatus 10C of the present exemplary embodiment compared to the image forming apparatus 10 of the first exemplary embodiment, it is possible to prevent image forming defect due to the above fixing defect. The other effects of the present exemplary embodiment are the same as the case of the first exemplary embodiment.

Fourth Exemplary Embodiment

Figure 13:
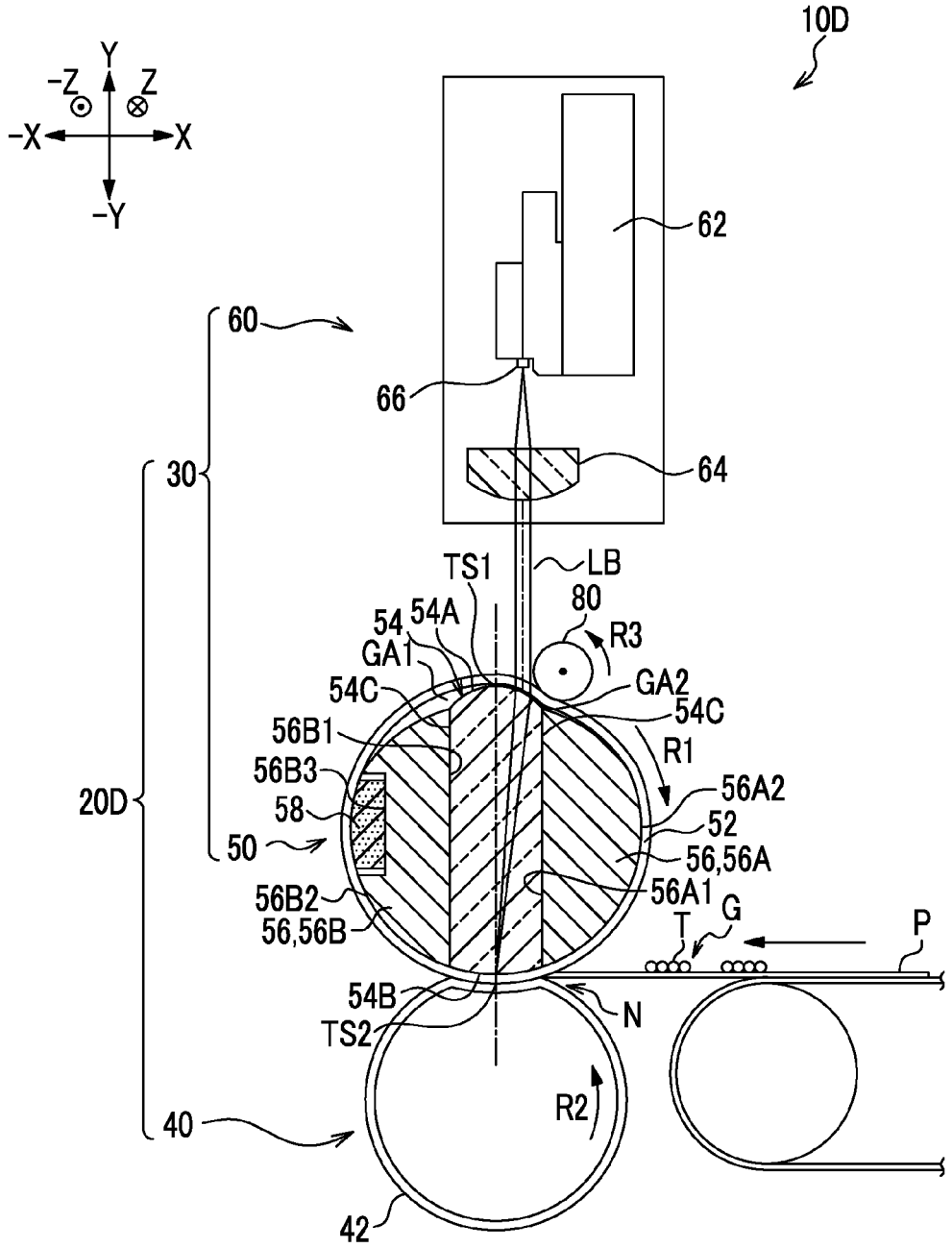
FIG. 13 is a schematic diagram (front view) showing a fixing device constituting an image forming apparatus according to a fourth exemplary embodiment.

Next, a fixing device 20D of a fourth exemplary embodiment will be described with reference to FIG. 13. According to the present exemplary embodiment, in a case where the same components as in the image forming apparatus 10 of the first exemplary embodiment, the image forming apparatus 10B of the second exemplary embodiment and the image forming apparatus 10C of the third exemplary embodiment are used, description is provided by attaching the same reference signs or the like to the components or the like.

Configuration

In the fixing device 20D of the present exemplary embodiment, the disposition of the main member 50 at the light irradiation unit 60 is the same as in the case of the fixing device 20B of the second exemplary embodiment. Specifically, the light irradiation unit 60 is disposed at a position shifted on the downstream side (one side in the apparatus width direction) in the movement direction of the transparent belt 52 from the top portion TS1 of the lens 54 when viewed in the apparatus depth direction. Similar to the fixing device 20C of the third exemplary embodiment, the fixing device 20D of the present exemplary embodiment includes the pushing member 80 that presses the outer peripheral surface of the transparent belt 52 and pushes the inner peripheral surface of the transparent belt 52 against the portion on the curved surface 54A of the lens 54 on the downstream side in the rotating direction of the transparent belt 52 from the top portion TS1. Except for this point, the fixing device 20D of the present exemplary embodiment has the same configuration as the fixing device 20 of the first exemplary embodiment. In addition, an image forming apparatus 10D of the present exemplary embodiment has the same configuration as the image forming apparatus 10 of the first exemplary embodiment except that the image forming apparatus 10D includes the fixing device 20D of the present exemplary embodiment instead of the fixing device 20 of the first exemplary embodiment.

Effects

The present exemplary embodiment, achieves combined effects of the second exemplary embodiment and the third exemplary embodiment. The other effects of the present exemplary embodiment are the same as the first exemplary embodiment.

Fifth Exemplary Embodiment

Figure 14:
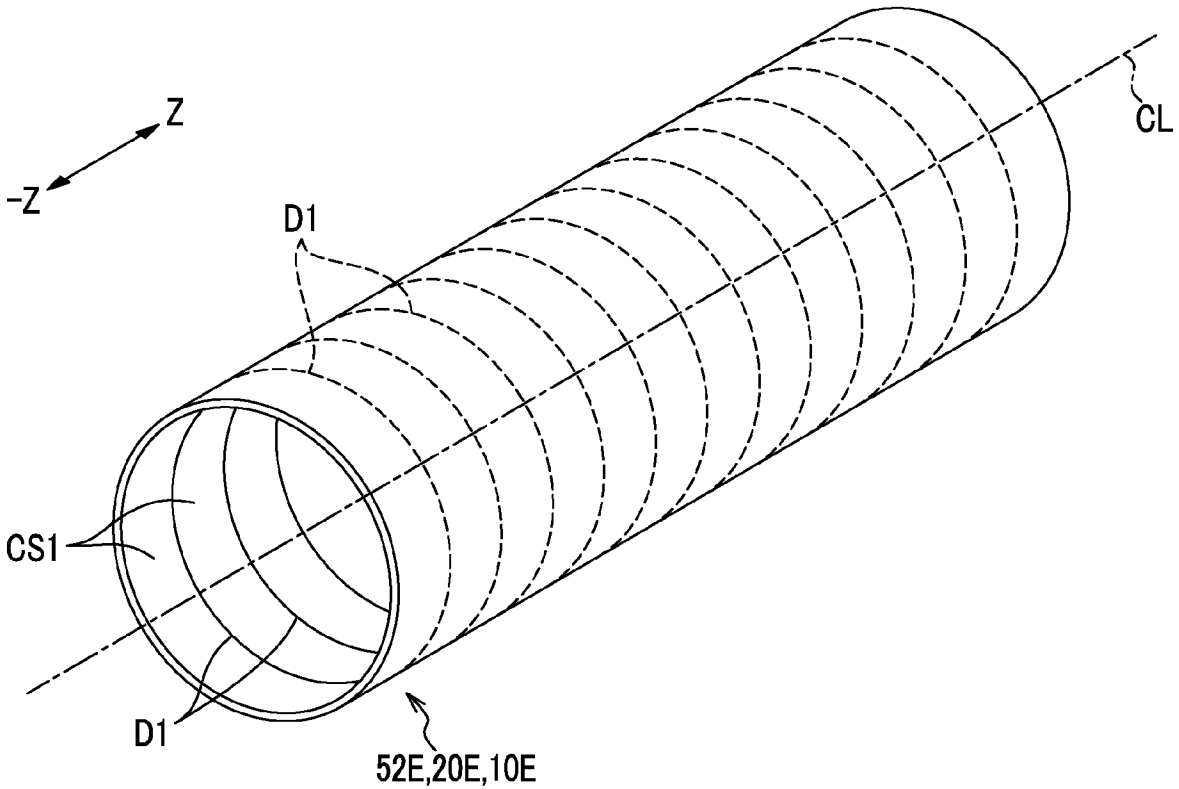
FIG. 14 is a schematic diagram (perspective view) showing a belt constituting a fixing device according to a fifth exemplary embodiment.
Figure 15:
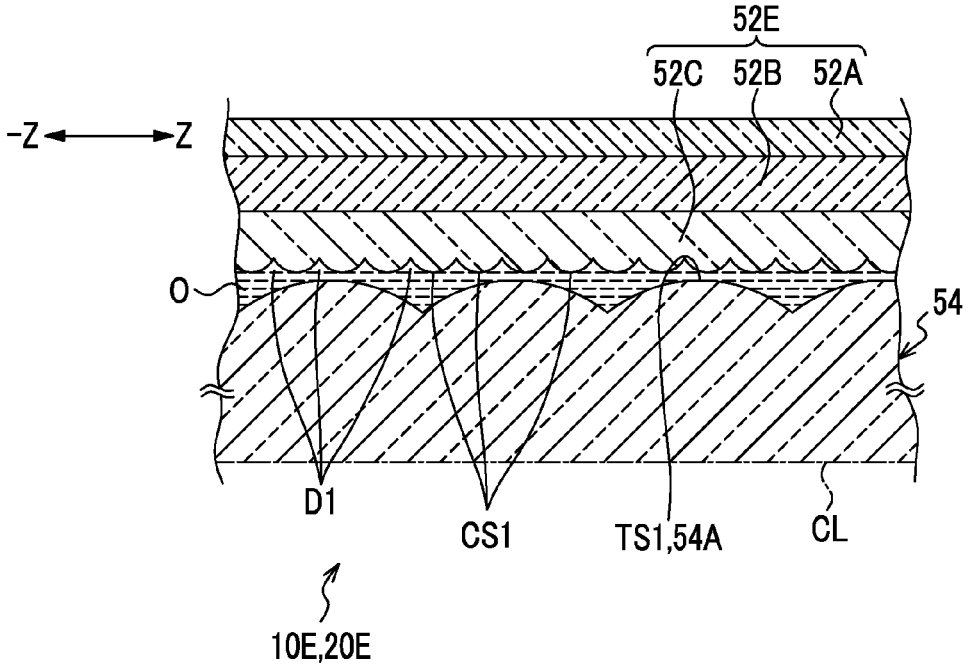
FIG. 15 is a partial sectional diagram showing a periphery of the top portion of the lens according to the fifth exemplary embodiment.

Next, a fixing device 20E of a fifth exemplary embodiment will be described with reference to FIG. 14 and FIG. 15. According to the present exemplary embodiment, in a case where the same components as in the image forming apparatus 10 of the first exemplary embodiment, the image forming apparatus 10B of the second exemplary embodiment, the image forming apparatus 10C of the third exemplary embodiment, and the image forming apparatus 10D of the fourth exemplary embodiment are used, description is provided by attaching the same reference signs or the like to the components or the like.

The fixing device 20E of the present exemplary embodiment includes a transparent belt 52E instead of the transparent belt 52 of the first to fourth exemplary embodiments. Specifically, plural convex sections CS1 which protrude toward the inner side (axis CL side) of the transparent belt 52E are formed across the entire circumference of the transparent belt 52E in a circumferential direction on an inner peripheral surface of the transparent belt 52E of the present exemplary embodiment. As shown in FIG. 15, the respective convex sections CS1 form curved lines protruding toward the inner side of the transparent belt 52E when the transparent belt 52E is viewed in a sectional plane taken along a virtual plane including the entire axis CL. The curved lines are continuously aligned in the axial direction of the transparent belt 52. In other words, the convex sections CS1 protrude toward the inner side of the transparent belt 52E and form curved surface shapes across the entire circumference of the transparent belt 52E in the circumferential direction. The convex sections CS1 are continuously arranged (connected on the curved surface) with other convex sections CS1 adjacent in the axial direction of the transparent belt 52E. In addition, a groove D1 is formed at a portion on which the adjacent convex sections CS1 are connected. The grooves D1 are formed across the entire circumference of the transparent belt 52E in the circumferential direction based on a relationship with the convex sections CS1 described above. The grooves D1 are arranged in parallel with the axial direction of the transparent belt 52E at an arrangement interval of the adjacent convex sections CS1. Except for this point, the fixing device 20E of the present exemplary embodiment has the same configuration as the fixing device 20 of the first exemplary embodiment. An image forming apparatus 10E of the present exemplary embodiment has the same configuration as the image forming apparatus 10 of the first exemplary embodiment except that the image forming apparatus 10E includes the fixing device 20E of the present exemplary embodiment instead of the fixing device 20 of the first exemplary embodiment.

Effects

As above, the grooves D1 are formed on the inner peripheral surface of the transparent belt 52E of the present exemplary embodiment. Thus, as shown in FIG. 15, in the transparent belt 52E, the silicone oil O supplied to the inner peripheral surface of the transparent belt 52E from the supply unit 58 reaches the vicinity of the top portion TS1 in a state of adhering to the groove D1 and, then, easily moves to the top portion TS1 and a portion beyond the top portion TS1. In the case of the fixing device 20E of the present exemplary embodiment, the distance between the top portion TS1 and the transparent belt 52E is wider at a portion at which the groove D1 is formed, compared to the cases of the fixing devices 20 and 20B to 20D of the first to fourth exemplary embodiments. As a result, in the case of the fixing device 20E of the present exemplary embodiment, the silicone oil O easily reaches the top portion TS1 and a portion beyond the top portion TS1, compared to the cases of the fixing devices 20 and 20B to 20D of the first to fourth exemplary embodiments.

Thus, according to the fixing device 20E of the present exemplary embodiment, it is possible to prevent a fixing defect due to a concentration defect of light with respect to a position, compared to the fixing devices 20 and 20B to 20D of the first to fourth exemplary embodiments. According to the image forming apparatus 10E of the present exemplary embodiment, it is possible to prevent an image forming defect due to the fixing defect, compared to the fixing devices 20 and 20B to 20D of the first to fourth exemplary embodiments. The other effects of the present exemplary embodiment are the same as the case of the first exemplary embodiment.

As described above, although the present invention has been described in detail in conjunction with the specific exemplary embodiments, the present invention is not limited to the aforementioned exemplary embodiments, and other exemplary embodiments are possible within the scope of the technical ideas of the present invention.

For example, in the fixing devices 20, 20B, 20C, 20D, and 20E according to the respective exemplary embodiments, it has been described that the silicone oil O adheres to the inner peripheral surface of the transparent belt 52 or 52E by bringing the supply unit 58 in which the silicone oil O is impregnated into the inner peripheral surface of the transparent belt 52 or 52E. However, if the silicone oil O has adhered to the inner peripheral surface of the transparent belt 52, the supply unit 58 may not be provided to the fixing devices 20, 20B, 20C, 20D, or 20E.

In the fixing devices 20, 20B, 20C, 20D, and 20E according to the respective exemplary embodiments, it has been described that the silicone oil O is used as an example of the lubricating liquid. However, as long as the liquid may reduce friction due to the sliding of the transparent belt 52 on the lens 54 and the guide unit 56 arranged inside the transparent belt 52 and transmit the light LB, the lubricating liquid used in the fixing devices 20, 20B, 20C, 20D, or 20E according to the present exemplary embodiment may not be the silicone oil O. For example, paraffin oil may be used.

In the fixing devices 20, 20B, 20C, 20D, and 20E according to the respective exemplary embodiments, it has been described that the cylindrical member 42 constituting the pressure unit 40 rotates around the axis by the driving source. However, any member may be used as long as the cylindrical member 42 may rotate around the axis by forming the nip N in cooperation with the transparent belt 52 during the fixing operation. For example, the cylindrical member 42 may rotate along with the rotation of the transparent belt 52 or 52E.

Figure 16A:
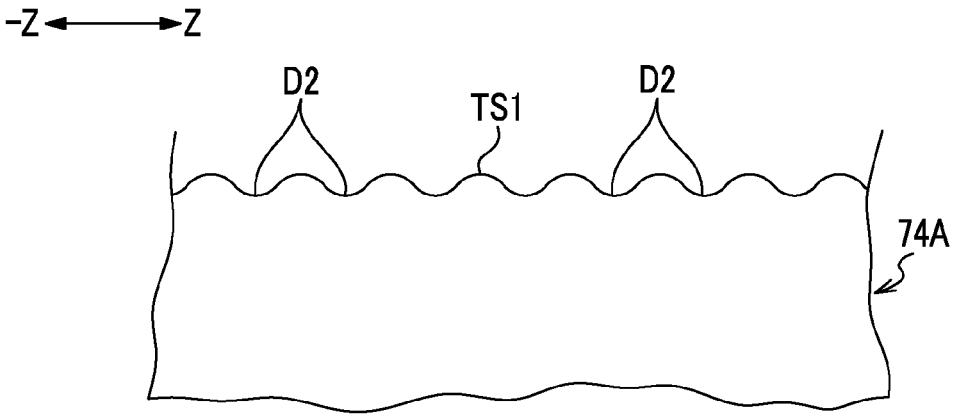
FIGS. 16A and 16B are schematic diagrams (partial sectional views) showing a modification example of the lens constituting the fixing device according to the first to fourth exemplary embodiments.
Figure 16B:
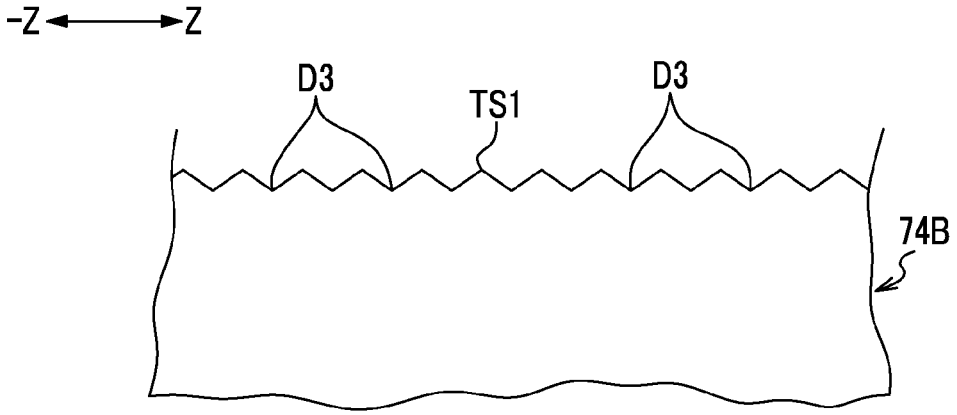

It has been described that the grooves D of the lenses 54 according to the respective exemplary embodiments are formed in parallel with the movement direction of the transparent belt 52 across from the upstream side from the top portion TS1 on the curved surface 54A in the movement direction of the transparent belt 52 to the downstream side from the top portion TS1. However, as long as the grooves D are formed on the transparent belt 52 and on the sliding surface on the curved surface 54A for the transparent belt 52 and the silicone oil O reaches the grooves D, the groove D may not limited to the grooves D according to the respective exemplary embodiments. For example, as illustrated in FIG. 16A, when the curved surface 74A is viewed in a sectional plane taken along a virtual plane (Y-Z plane) including the entire top portions TS1, grooves D2 may correspond to concave portions of a sinusoidal-wave shape from the one end side to the other end side in the apparatus depth direction. In addition, as illustrated in FIG. 16B, when a curved surface 74B is viewed in a sectional plane taken along a virtual plane (Y-Z plane) including the entire top portions TS1, grooves D3 may correspond to concave portions of a triangle-wave shape from the one end side to the other end side in the apparatus depth direction.

Figure 17A:
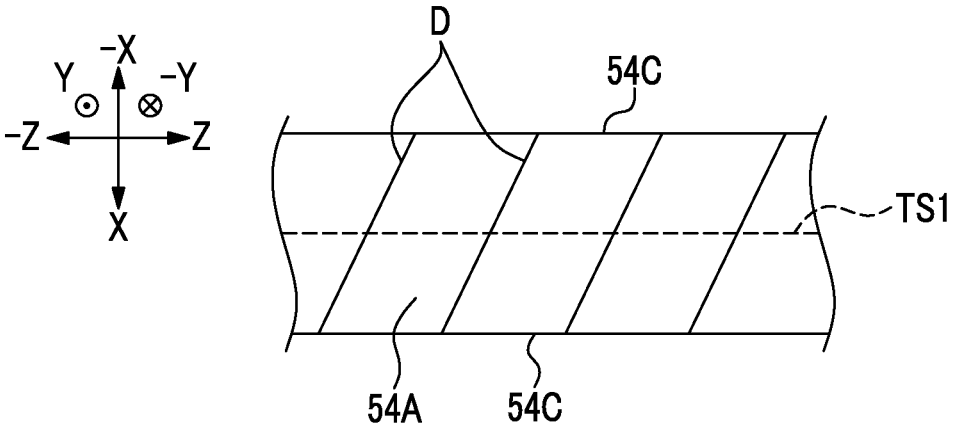
FIGS. 17A and 17B are diagrams (top views) schematically showing the modification example of the lens constituting the fixing device according to the first to fourth exemplary embodiments.
Figure 17B:
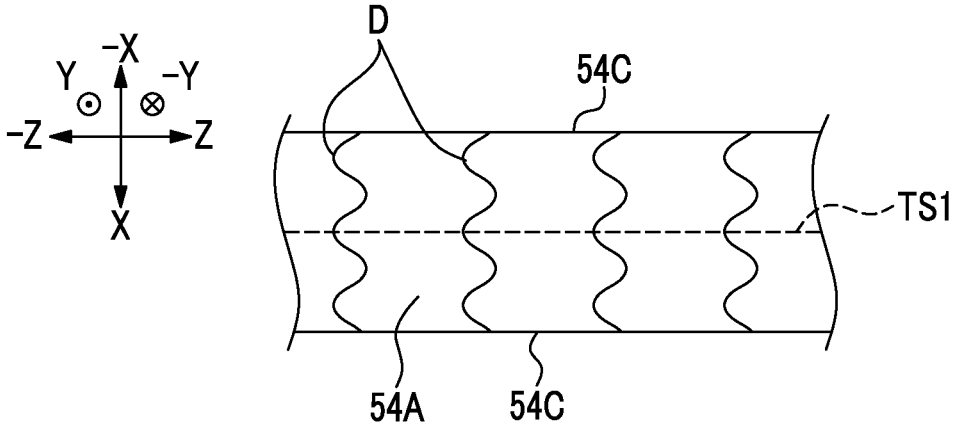
Figure 18:
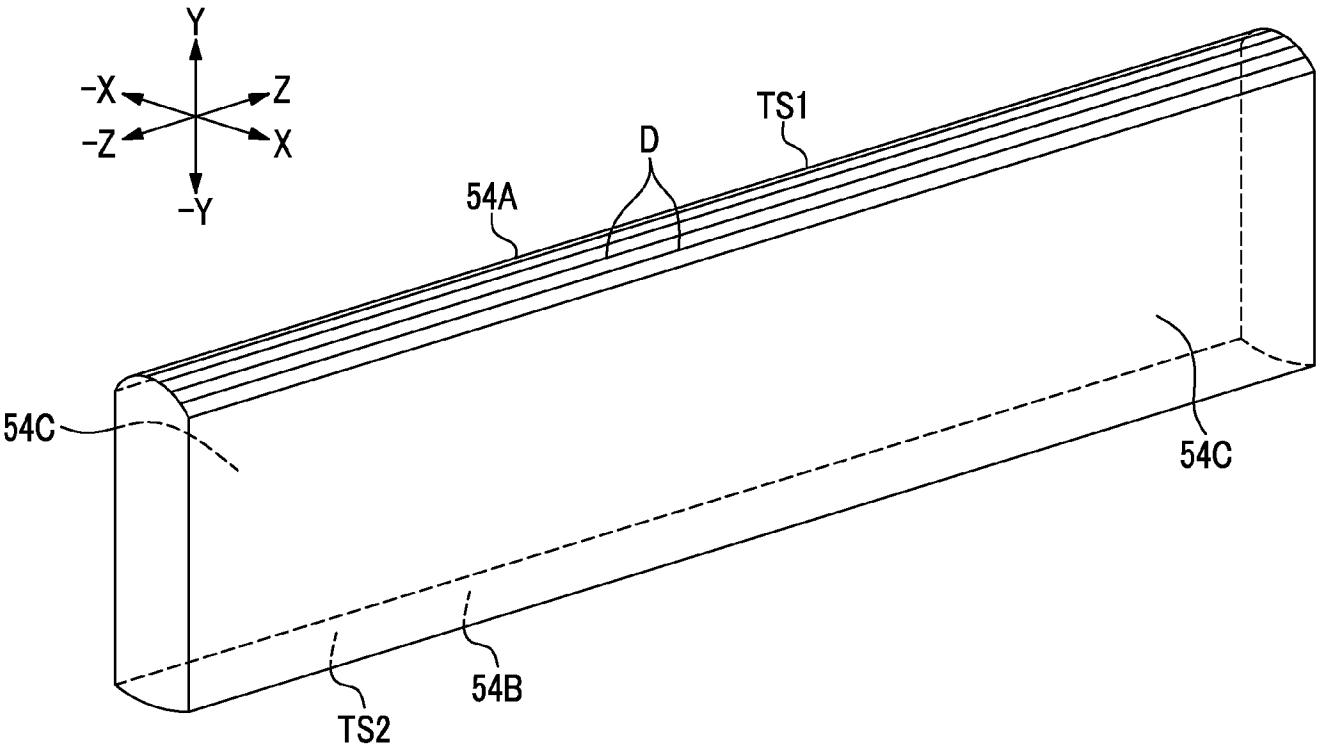
FIG. 18 is a diagram (perspective view) schematically showing another modification example of the lens constituting the fixing device according to the first to fourth exemplary embodiments.

It has been described that the grooves D of the lenses 54 according to the respective exemplary embodiments are formed in parallel with the movement direction of the transparent belt 52 across from the upstream side from the top portion TS1 on the curved surface 54A in the movement direction of the transparent belt 52 to the downstream side from the top portion TS1. However, as long as the grooves D are formed on the transparent belt 52 and on the sliding surface on the curved surface 54A for the transparent belt 52 and the silicone oil O reaches the grooves D, the groove D may not be formed in parallel with the movement direction of the transparent belt 52 unlike the grooves D according to the respective exemplary embodiments. For example, as illustrated in FIG. 17A and FIG. 18, the grooves D may be formed in a direction inclined with respect to the movement direction of the transparent belt 52. In addition, as illustrated in FIG. 17B, the grooves D may be formed in a curved line when viewed in the apparatus height direction.

Figure 19A:
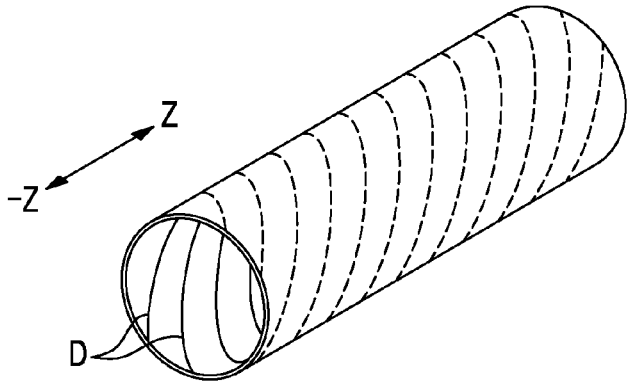
FIGS. 19A, 19B, and 19C are schematic diagrams (perspective views) showing a modification example of the transparent belt constituting the fixing device according to the first to fourth exemplary embodiments.
Figure 19B:
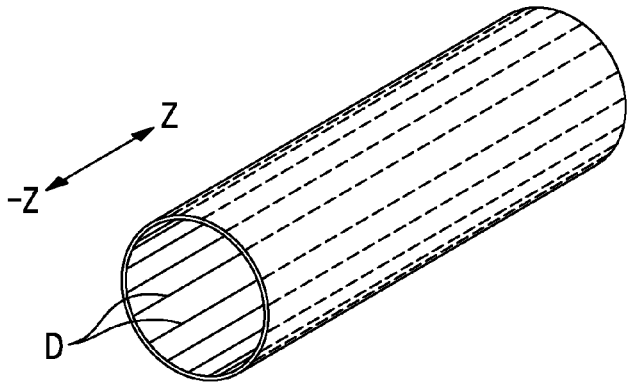
Figure 19C:
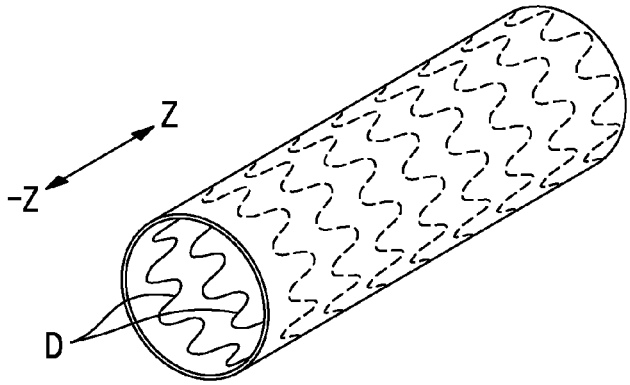

In addition, in the description of the transparent belt 52E of the fixing device 20E of the fifth exemplary embodiment, the groove D1 is formed across the entire circumference of the transparent belts 52 in the circumferential direction. However, as long as a large amount of the silicone oil O may be caused to reach the top portion TS1 of the lens 54 from the transparent belt 52 based on the rotation of the transparent belt 52, the direction of the groove D1 may not be formed in the circumferential direction of the transparent belt 52. If the same conditions are satisfied, the groove D1 may not be formed across the entire circumference of the transparent belt 52 in the circumferential direction. For example, like the groove D4 of the transparent belt shown in FIG. 19A, the groove D1 may be formed in a direction inclined with respect to the axial direction (Z and −Z directions) of the transparent belt. Like a groove D5 of the transparent belt shown in FIG. 19B, the groove D1 may be formed in the axial direction of the transparent belt. In addition, like a groove D6 of the transparent belt shown in FIG. 19C, the groove D1 may be formed in a curved line.

According to the first exemplary embodiment, the transparent belt 52 has been described to slide on the lens 54 with the curved surface 54A as the sliding surface. However, in the fixing device 20, the transparent belt 52 may be configured to move through a determined path without sliding on the curved surface 54A of the lens 54. The same is true of the other exemplary embodiments.

According to the first exemplary embodiment, it has been described that the respective convex sections CS (or grooves D) formed on the curved surface 54A of the lens 54 are continuously arranged in the apparatus depth direction. However, the respective convex sections CS (or grooves D) may not be continuously arranged in the apparatus depth direction. For example, the convex sections CS (or grooves D) adjacent in the apparatus depth direction may not have equal intervals. In addition, the plural convex sections CS (or grooves D) may not be formed (one convex section CS may be formed).

According to the exemplary embodiments, the first to fifth exemplary embodiments have been individually described.

However, an aspect obtained by combining parts from the respective exemplary embodiments is included in the technical scope of an exemplary embodiment. For example, when the fixing device 20B of the second exemplary embodiment includes the transparent belt 52E of the fifth exemplary embodiment instead of the transparent belt 52, the fixing device is included in the technical scope of an exemplary embodiment. In addition, when the fixing device 20C of the third exemplary embodiment includes the transparent belt 52E of the fifth exemplary embodiment instead of the transparent belt 52, the fixing device is also included in the technical scope of an exemplary embodiment.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A lens comprising:

a curved surface including a top portion at one end of the lens, and another curved surface including a bottom portion of the lens on the other end of the lens opposite to the top portion, wherein a groove is formed on the curved surface, wherein light incident to the curved surface is concentrated on the other end of the lens, and wherein a curvature of the curved surface at the top portion is greater than a curvature of the curved surface at the bottom portion and the curved surface at the top portion is curved opposite to the curved surface at the bottom portion.

2. A fixing device comprising:

an endless transparent belt that moves through a predetermined path;

the lens according to claim 1 having the curved surface to which a lubricating liquid adheres; and a light source that causes the light concentrated on an object to be fixed to be incident to a portion of an outer peripheral surface of the transparent belt, which faces the curved surface.

3. The fixing device according to claim 2, wherein the groove is formed along a movement direction of the transparent belt.

4. The fixing device according to claim 2, wherein a groove is formed on an inner peripheral surface of the transparent belt.

5. The fixing device according to claim 3, wherein a groove is formed on an inner peripheral surface of the transparent belt.

6. The fixing device according claim 2, further comprising:

a pushing member that presses the outer peripheral surface and pushes the inner peripheral surface of the transparent belt against a portion at the downstream side of the top portion on the curved surface in the movement direction of the transparent belt.

7. The fixing device according claim 3, further comprising:

a pushing member that presses the outer peripheral surface and pushes the inner peripheral surface of the transparent belt against a portion at the downstream side of the top portion on the curved surface in the movement direction of the transparent belt.

8. The fixing device according claim 4, further comprising:

a pushing member that presses the outer peripheral surface and pushes the inner peripheral surface of the transparent belt against a portion at the downstream side of the top portion on the curved surface in the movement direction of the transparent belt.

9. The fixing device according claim 5, further comprising:

a pushing member that presses the outer peripheral surface and pushes the inner peripheral surface of the transparent belt against a portion at the downstream side of the top portion on the curved surface in the movement direction of the transparent belt.

10. An image forming apparatus comprising:

a forming unit that forms a developer image using a developer as an object to be fixed on a medium; and the fixing device according to claim 2 that concentrates light on the developer and fixes the developer to the medium.

* * * * *